United States Patent [19]

Stadjuhar et al.

[11] Patent Number: 4,496,945

[45] Date of Patent: Jan. 29, 1985

[54] METHOD AND APPARATUS FOR SYMBOL DISPLAY DEVICE

[75] Inventors: Robert C. Stadjuhar; Cecil S. Renfro, both of Colorado Springs, Colo.

[73] Assignee: Skyline Products, Inc., Colorado Springs, Colo.

[21] Appl. No.: 384,196

[22] Filed: Jun. 3, 1982

[51] Int. Cl.[3] ..... G09G 3/16

[52] U.S. Cl. ..... 340/764; 340/815.04; 340/815.08; 340/815.09; 340/806; 40/450; 40/451

[58] Field of Search ..... 340/764, 806, 807, 815.04, 340/815.08, 815.09, 815.27, 815.05; 40/450, 451, 503, 532

[56] References Cited

U.S. PATENT DOCUMENTS

| | | | |
|---|---|---|---|
| 1,357,457 | 11/1920 | Jorgensen | 40/450 |
| 3,273,270 | 9/1966 | Skrobisch | 340/764 |
| 3,307,170 | 2/1967 | Aoyama et al. | 340/815.08 |
| 3,363,347 | 1/1968 | Benson | 340/764 |
| 3,975,728 | 8/1976 | Winrow | 340/815.05 |
| 4,024,532 | 5/1977 | Sherwin | 340/815.08 |
| 4,040,193 | 8/1977 | Matsuda et al. | 40/451 |
| 4,070,668 | 1/1978 | Kawaharada et al. | 340/764 |
| 4,117,478 | 9/1978 | Skrobisch | 340/815.08 |
| 4,152,853 | 5/1979 | Lewis | 40/451 |
| 4,161,832 | 7/1979 | Bergamini | 340/764 |
| 4,223,464 | 9/1980 | Winrow | 40/450 |
| 4,308,528 | 12/1981 | Hummel et al. | 340/764 |
| 4,389,804 | 6/1983 | Seibert et al. | 340/815.04 |

FOREIGN PATENT DOCUMENTS

| | | | |
|---|---|---|---|
| 2440589 | 7/1980 | France | 340/764 |

*Primary Examiner*—Gerald L. Brigance
*Attorney, Agent, or Firm*—Young & Martin

[57] ABSTRACT

Method and apparatus for creating a display including a novel shuttering assembly and drive mechanism therefor. The shuttering assembly alternately presents first and second shutter panels to a window forming an element of the display. The panels are connected to cams on a rotatable axle positioned in spaced relation to the opening and alternately mask the opening on reciprocal rotation of the axle. A drive rod is connected at a first end to a dog on the axle to rotate the axle. The drive mechanism moves the drive rod which has its second end connected to a movable drive member. Preferably a plurality of shutter assemblies are provided, and a reciprocally rotatable drive disc carries solenoids having plungers to selectively engage the drive members. A single cycle motor rotates the drive disc, and logic circuitry permits selected activation of the solenoids. The method includes the step of moving all shutter assemblies into a no display mode at mid-cycle during the reciprocal movement of the drive disc.

30 Claims, 10 Drawing Figures

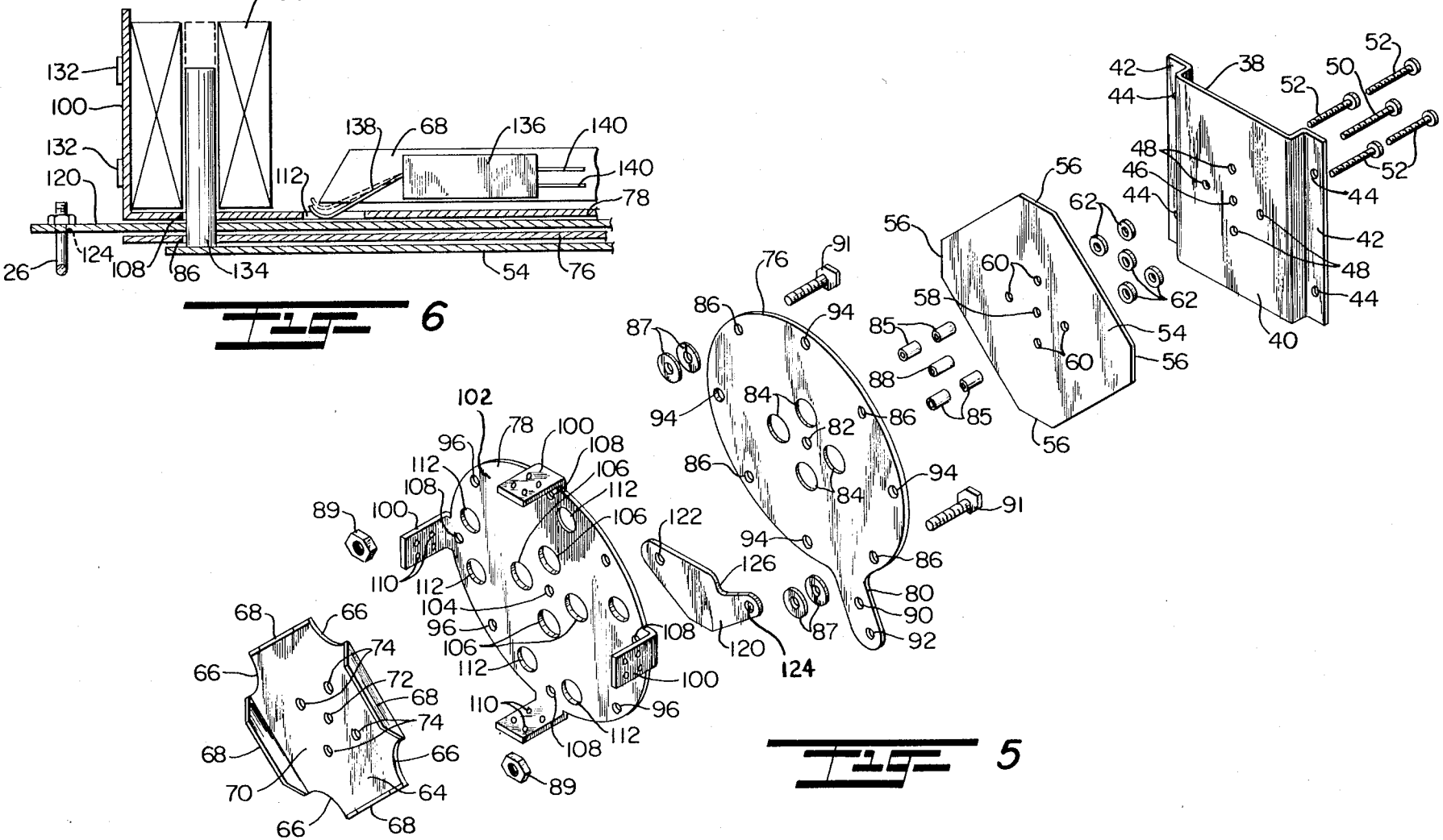
5
6

METHOD AND APPARATUS FOR SYMBOL DISPLAY DEVICE

BACKGROUND

The present invention relates to a method and apparatus for creating a symbolic display, such as a digital display, which is visually perceptable to observers both during the day and at night. Accordingly, this method and apparatus is particularly useful for creating symbols, such as digits, which are formed out of an array of symbol segments so that selected segments will form different selected symbols and which may be remotely controlled by a user to quickly and easily display a desired symbol. Thus, the present invention is adaptable for large format displays such as those used as information or advertising signs.

Remotely controlled display panels have been known for sometime and have been used to display various visual symbols such as numerals and letters. Prior art devices have utilized matrix arrays of lights to display symbols formed by activating a desired pattern of lights. Other known devices utilize a matrix array of discs wherein one surface of the disc is colored to match a background while the opposite surface is colored with a contrasting material. The symbol pattern is defined by manipulating the discs to presenta desired pattern of contrasting surfaces. Other prior art devices have used shutters for selectively masking symbol segments so that the pattern of segments creates the desired symbol.

A specific example of an electromechanical display assembly is shown in U.S. Pat. No. 4,040,193 issued Aug. 9, 1977 to Matsuda, et al wherein a matrix array of display windows are selectively exposed or masked by means of a plurality of rotatable spheres. A portion of each of these spheres is painted a color that matches the background while the remaining portion of this sphere is painted a contrasting color. An electromagnet controllably rotates selected spheres to generate the symbol pattern.

U.S. Pat. No. 4,070,668 issued Jan. 24, 1978 to Kawaharada, et al discloses a digital display wherein segment windows are selectively masked by means of a pivotal panel which is moved into and out of a masking orientation to a display segment window by means of an electromechanical activating system.

Other types of devices utilize the concept of selectively masking a segment window so that the exposed segments define the selected digit while the masked segments are not visually perceptable. U.S. Pat. No. 4,164,824 issued Aug. 21, 1979 to Nidelkoff shows a seven segment digit display wherein the window shutter elements are operated manually by sliding the shutter panel into a position masking segment window to mask that segment window. U.S. Pat. No. 4,063,377 issued Dec. 20, 1977 to Hukill discloses a changeable display device which is manually operated from a remote location by means of a plurality of cables which are connected to shutter element which define the displayed symbol.

Despite the panoply of display systems which have been developed in the past, there is still a need for a reliable display device which is simple in construction yet which can reliably reproduce a selected range of symbols on command from a remote location. There is a further need for a rugged, outdoor display device that can be visually perceived by an observer both during the day and at night.

SUMMARY OF THE INVENTION

One object of the present invention is to provide a new and useful method of selectively masking symbol display segments so that a selected symbol may be reliably and easily reproduced with a minimum of operational cost.

It is another object of the present invention to provide a method of selectively masking display symbol segments in a manner wherein the display cycles through a "no display" mode and a "display" mode upon command.

Another object of the present invention is to provide a method of selectively masking a display segment in a manner wherein the display may easily be read either during the day or at night.

A further object of the present invention is to provide a novel remote display apparatus which is inexpensive in manufacture yet which is of reliable and durable construction for outdoor use.

Yet another object of the present invention is to provide a large format digital display wherein a selected symbol may be changeably displayed in a manner such that power is only consumed by the device during alteration of the display and which requires no power in maintaining the selected display during daylight hours.

To accomplish these objects, the present invention relates to a large format display unit particularly adapted for digital displays and a method for constructing a selected digit on such a display. To accomplish this, the preferred embodiment of the display unit includes a housing structure which has a visually observable panel constructed with a plurality of windows or openings that form an array of symbol segments such that different combinations of the segments define selected symbols. The symbol segments each have an associated masking or shuttering assemblies so that each segment may independently be placed in a "display" or "no display" mode. A drive mechanism operates the shuttering assemblies. Preferably the drive mechanism and the shuttering assemblies are mounted within the housing of the display device. Movable drive members interconnect the shuttering assemblies and the drive mechanism so that selected operation of the drive mechanism implements the selected shuttering assemblies thereby defining the symbol. To this end, a trigger means is associated with the drive mechanism for selective operation of the drive members, and a drive means, such as a motor, is connected to the drive mechanism to mechanically operate the system.

With greater particularity, in the preferred embodiment, each shuttering assembly includes an axle which is positioned adjacent a window opening. The axle is rotatable between first and second positions, and a pair of cam members are secured to the axle on its opposite ends. A first shutter panel, sized for masking the opening, is pivotally secured between the cam members so that it moves into and out of a masking relationship with the opening where the axle is rotated between the first and second positions, respectively. A second shutter panel, sized for masking the opening, is pivotally secured to the panel that contains window openings along an edge of the opening. The second shutter panel is also secured to the cam members such that rotation of the axle pivots the second shutter panel into a masking orientation when the first shutter panel is moved out of a masking orientation, and the second shutter panel is moved out of masking relationship with the opening when the first panel is moved into a masking position.

Preferably, a pair of drive mechanisms are used in the preferred embodiment of the present invention with each drive mechanism including a drive disc which is rotatably mounted on a support structure in the housing. A motor rotates each drive disc in a reciprocal manner between two positions. Drive members in the form of pivotal plates are associated with each shutter apparatus and are mounted in the housing and is connected to a respective shuttering axle by means of a drive rod. The drive disc carries selectively actualable engagement means, such as plunger solenoids, which operate to selectively engage respective one of the drive members so that drive disc will selectively operate the shutter assemblies. A trigger means triggers the engagement means for selectively engaging the drive members so that an operator may choose the pattern of shutter assemblies.

It is preferred that the shutter panels be selected such that one shutter panel is opaque having an external surface that blends in with the background of the display unit. The second shutter panel is preferably a translucent panel that is formed of a material having a contrasting color to that of the background so that display of the second shutter panel creates a visual display element that is readable in daylight. The device is adapted for back lighting so that the translucent panels may also be perceivable during night as a result of the internal illumination of the system.

Accordingly, the method broadly contemplated by this invention includes the first steps of providing a shutter assembly which can mask an opening, including a plurality of first shutter panels for alternately masking an array of opening corresponding to a display segment array upon movement of a drive rod. A drive plate and movable drive members are provided and carries engagement means for selectively engaging the drive members. The method then includes the reciprocating of the drive plate past the drive members through a complete cycle of motion from a start cycle, to a mid-cycle and an end cycle that corresponds to the start cycle of the next successive cycle. The start and end cycles comprise display modes and the mid-cycle comprises a no display mode. All shutter panels are moved into a no display or masking mode at mid-cycle. The engagement means are implemented during the mid-cycle of this motion to engage selected drive members and thereby move selected shutters into a display mode at end cycle.

These and other objects of the invention will become more readily appreciated and understood from a consideration of the following detailed description of the preferred embodiment when taken together with the accompanying drawings, in which:

BRIEF DESCRIPTION OF THE DRAWINGS

FIG. 5 is an exploded view in perspective showing the main elements of the drive mechanism according to the preferred embodiment of the present invention;

FIG. 6 is a side view in cross-section of a portion of the assembled drive mechanism shown in FIG. 5;

DETAILED DESCRIPTION OF THE PREFERRED EMBODIMENT

The present invention relates to display devices adapted for selectively presenting a symbol for visual observation both during the day and at night. To this end, the present invention includes novel shuttering apparatus and novel drive mechanism for presenting a symbolic display. The present invention thus encompasses a novel method for producing the displayed symbol.

It should be appreciated that the present invention is applicable in a wide form of display units, such as those used for displaying both letters and numerals, and is applicable for any system wherein it is desired to selectively mask symbol segments to create a display. To this end, the present invention is described with respect to a digital display although this shuttering system and drive mechanism could be used for other displays, and indeed, could be used for other purposes analogous to display units wherein a shuttering or masking assembly is desirable.

Figure 1:
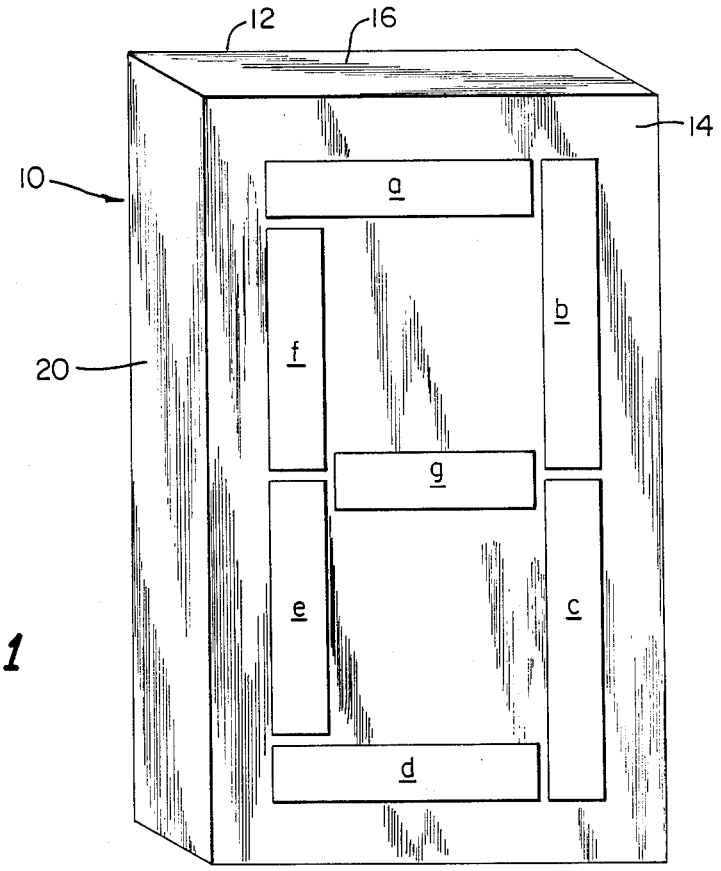
FIG. 1 is a perspective view of a digital display according to the preferred embodiment of the present invention.

As is apparent in FIG. 1, digital display 10 according to the preferred embodiment of the present invention is contained in housing 12 which has a front wall 14, a top wall 16, a bottom wall 18 and a pair of side walls 20. A symbolic display in digital format is formed of a plurality of symbol segments a, b, c, d, e, f, and g. This seven segment system of digital display is well known in the prior art since it has long been determined that the numerals 0–9 may be represented by a seven segment array such as that shown in FIG. 1. Typically, these segments a–g are formed by openings or windows in the front surface 14, and a shuttering or masking assembly corresponds to each of these segments such that a respective segment may selectively be placed in an active or "display" modes and inactive or "no display" modes. Hence, in a "display" mode, the segment may be visually perceived while in a "no display" mode the segment is obscurred.

The present invention is directed to the entire shuttering mechanism for such a display unit. This mechanism includes both a shutter assembly for each of the segments a–g and a drive assembly that selectively operates all of the shuttering assemblies so that a selected symbol or digit may appear on display 10.

Figure 2:
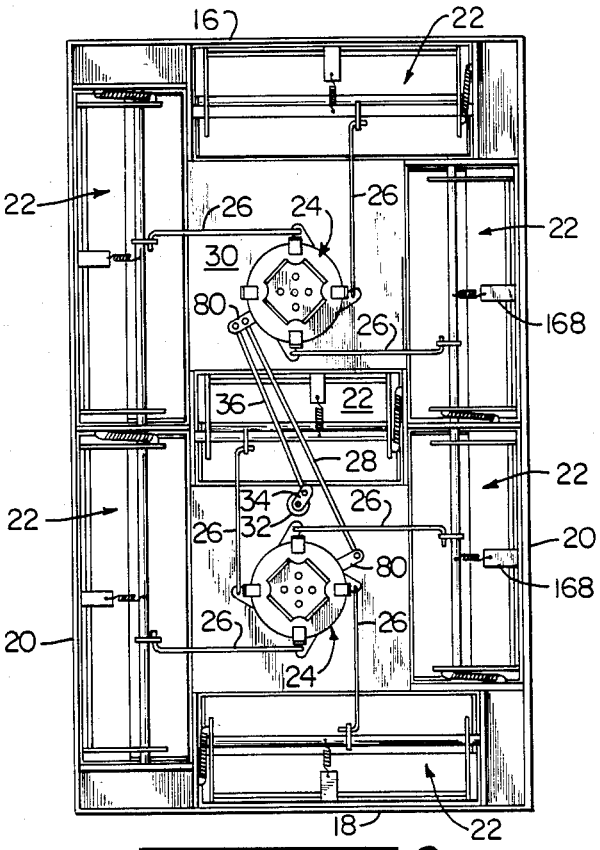
FIG. 2 is a rear elevational view of the operating mechanism of the digital display shown in FIG. 1 including the shuttering assemblies and drive mechanisms therefor.
Figure 3:
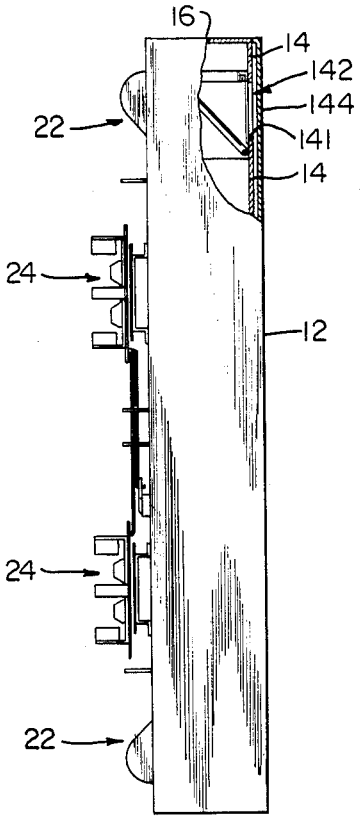
FIG. 3 is a side view in elevation and partially broken away showing preferred embodiment of the present invention.

The entire shuttering mechanism may be seen in FIG. 2 and 3, but is shown in greater detail in FIGS. 4–8. As is shown in FIG. 2, seven shuttering assemblies 22 are mounted in housing 12 with a shuttering assembly 22 corresponding to each respective segment a–g. A pair of drive mechanisms 24 operate shuttering assemblies 22, with drive mechanisms 24 being connected to shuttering assemblies 22 by drive rods 26 in a manner described below. Drive mechanisms 24 are linked together by means of a link rod 28 and are journaled for rotation on support structure 30 in housing 12. Support structure 30 consists of internal support panels mounted in housing 12 to give structural strength to display 10. Support structure 30 providing convenient attachment for two drive mechanisms 24. Drive mechanisms 24 are rotatable in a cyclical manner. A motor 32 has a cam 34 connected to one of drive mechanisms 24 by means of a link rod 36 so that each cycle of motor 32 causes both drive mechanisms 24 to reciprocate through a relatively small rotational angle. This motion is then utilized to selectively operate shuttering assemblies 22 in a manner described in greater detail below.

The construction of drive mechanisms 24 is shown in greater detail in FIGS. 4, 5, 6, and 7. As is evident in FIG. 5, a representative drive mechanism 24 includes three metal mounting plates which are immovably affixed to support structure 30 in housing 12. A base plate 38 has a generally U-shaped cross-section with a base portion 40 and a pair of lateral wings 42 which are provided for mounting base plate 38 to support structure 30. To this end, a plurality of mounting holes 44 are formed in wings 42 so that base plate 38 may be bolted or otherwise attached to support structure 30. A hole 46 is centrally located in base portion 40 and is surrounded by a plurality of holes 48. Hole 46 receives an axle bolt 50, and holes 48 receive mounting bolts 52. Bolts 50 and 52 extends through base portion 40 and project outwardly away from support structure 30 so that they may mount the remaining elements of drive mechanism 24 to base plate 38.

An intermediate plate 54 is preferably constructed of a nonmetallic materials such as a phenolic or acrylic, and is secured to base plate 38 in a generally immovable manner, plate 54 acts as a limit stop plate for plungers 134 discussed below, but it should be appreciated that plate 54 could be eliminated if other limit stops were provided for plungers 134 since plate 54 is used to prevent other extension of plungers 134. Plate 54 is formed as a square having truncated corners 56, and is provided with the central hole 58 which is aligned with hole 46 and which receive axle bolt 50. A plurality of holes 60 surround hole 58 and are aligned with holes 48 for receiving mounting bolts 52. Intermediate plate 54 is positioned on a base plate 38 so that it is in substantially parallel spaced apart relation to base portion 40, with plate 54 being spaced from base portion 40 by means of a plurality of spacer washers 62 which receive bolts 50 and 52 and which are positioned between base plate 38 and intermediate plate 54. It should be understood, though, that intermediate plate 54 could abut base plate 38, and, indeed, plates 38 and 54 could be combined as a common support member.

An outer plate 64 is secured to base plate 38 and intermediate plate 54 by bolts 50 and 52. Outer plate 64 has a generally square configuration, but has arcuately cut corners 66. Upright flanges 68 extend along each edge of plate 64 between corners 66 so that flanges 68 project outwardly away from base plate 38. Flanges 68 are preferably formed by folding the edges of plate 64 so that flanges 68 are at right angles with central portion 70 of base plate 64. Central portion 70 of plate 64 is provided with a central hole 72 which receives axle mount 50 and a plurality of surrounding holes 74 which receive mounting bolts 52. Thus, outer plate 64 is immovably secured to base plate 38 and intermediate plate 54 with these three plates being immovably secured to support structue 30 and correspondingly to housing 12. A central spacer or bushing 88 and four outer spacers or bushings 85 are positioned on bolts 50 and 52 respectively between intermediate plate 54 and outer plate 64 to maintain plates 54 and 64 in parallel spaced apart relation. Preferably, bushings 85 and 88 are constructed of bronze, aluminum or other suitable material.

Two plates are rotatably mounted on axle bolt 50 between intermediate plate 54 and outer plate 64. Specifically, a drive plate 76 is positioned adjacent intermedite plate 54 and a driven plate 78 is positioned adjacent outer plate 64. Bushings 85 and 88 thus separate plates 54 and 64 to provide clearance for plates 76 and 78. Drive plate 76 is generally circular in shape but which has a radial arm 80 extending outwardly therefrom. A central hole 82 is provided in drive plate 76, and is sized to receive bushing 88 which in turn receives axle bolt 50. Bushing 88 in hole 82 provides a bearing surface for plate 76. In order to accommodate this rotational motion, a plurality of enlarged holes 84 surround central hole 82 and are positioned to receive mounting bolts 52 and bushings 85. However, since holes 84 are enlarged to have a diameter significantly greater than the diameter of bolts 52 and spacers 85, drive plate 76 may reciprocally rotate a small angular amount on axle bolt 52. Drive plate 76 has a first set of four holes 86 and a second set of four holes or bores 94 all located adjacent its peripheral edge. Holes 86 are spaced ninety degrees apart from one another about central bore 82. Likewise, bores 94 are spaced ninety degrees apart from one another. Radial arm 80 has a pair of holes 90 and 92 which are adapted to receive threaded end portions of rods 28 and 36 respectively.

Driven plate 78 is positioned adjacent outer plate 64 so that it is sandwiched between outer plate 64 and drive plate 76. Driven plate 78 is circular in shape and has four flange brackets 100 which project outwardly away from base plate 38 and drive plate 76. Preferably flange brackets 100 are formed unitarily with a central circular portion 102 of driven plate 78 with flange brackets 100 being constructed as radial extensions of central portion 102 which are then folded at right angles to central portion 102. Driven plate 78 has a central hole 104 and a plurality of enlarged holes 106 which correspond to enlarged holes 84 in drive plate 76. Hole 104 receives axle bolt 50 and bushing 88 so that driven plate 76 may rotate reciprocally on the bearing surface of bushing 88 and thus on axle bolt 50. Enlarged holes 106 accommodate mounting bolts 52 and bushings 85 in a manner described with respect to holes 84 of drive plate 76.

A set of plunger bores 108 and a second set of holes 96 are formed near the peripheral edge of central portion 102. Bores 108 each lies on the radial line containing its corresponding bracket 100 which are spaced ninty degrees apart. Holes 96 are likewise spaced ninety degrees apart from one another. Brackets 100 each have a plurality of mounting holes 110 whose function is described below. Likewise, driven plate 78 includes a pair of detent holes 112 located near its peripheral edge adjacent each flange bracket 100. The function of holes of 112 is also described in greater detail below. It should be appreciated from the description, that flange brackets 100 are positionable in arcuate corners 66 of outer plate 64.

Drive plate 76 and driven plate 78 are secured to one another for common rotation. To the end, the sets of holes 86 and 96 are oriented to align with one another, and bolts 91 may be extended therethrough and secured by nuts 89. A pair of washers 87 are mounted on each bolt 91 so that plates 76 and 78 are slightly spaced apart from one another. It should be appreciated that only two such bolts 91 are shown in FIG. 5, but that, in actual construction, a greater number of bolts 91 may be used. This orientation also serves to align the sets of bores 108 and 94.

A plurality of drive members 120 are provided, and each is pivotally mounted on a respective bushing 85 on mounting bolt 52 between drive plate 76 and driven plate 78. A representative drive member 120 is shown in FIG. 5 and includes a mounting hole 122 adjacent one end and a second mounting hole 124 at its opposite end. Mounting hole 122 receives a respective mounting bolt 52, and it should be understood that each drive member 120 may freely pivot on bushing 85 surrounding mounting bolt 52 between drive plate 76 and driven plate 78 and independently thereof. Washers 87 allow sufficient space between plates 76 and 78 for such pivotal motion. Mounting hole 124 is provided to receive and mount a respective drive rod 26 for operation of respective shuttering assembly 22. Drive member 120 has an arcuate portion 126 which has a purpose described in greater detail below.

Figure 4:
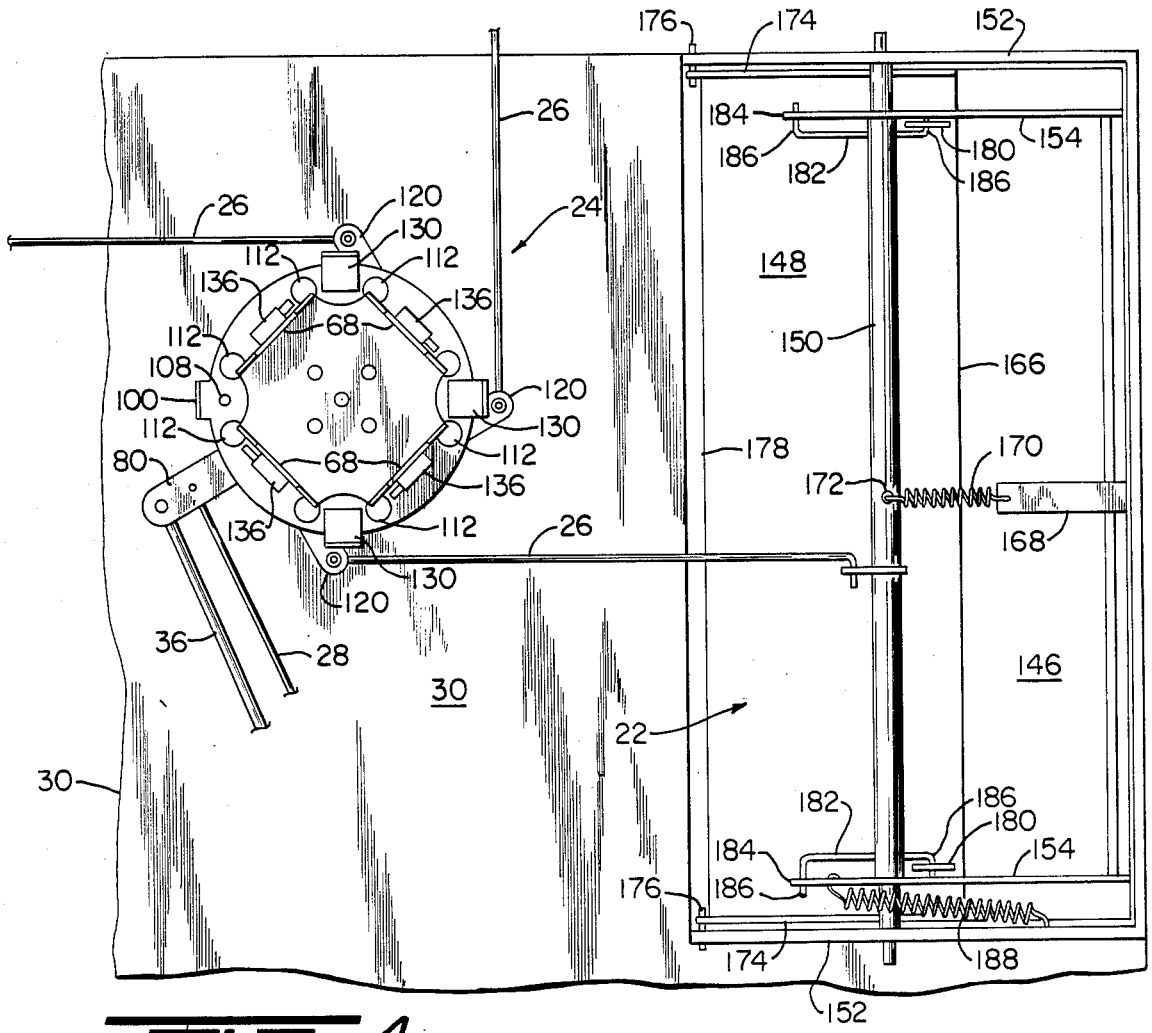
FIG. 4 is a top plan view of a shuttering apparatus and control mechanism therefor according to the preferred embodiment of the present invention.

As is shown in FIGS. 4 and 6, drive mechanism 24 includes a plurality of solenoids 130 each of which is mounted to a respective flange bracket 100 by means of screws or rivots 132 which extend through holes 110. As is best shown in FIG. 6, each solenoid 130 includes a plunger 134 which is in the form of a rod and that is normally biased to protrude from solenoid core 136, but which is drawn into core 136 upon activation of solenoid 130, as is shown in phantom in FIG. 6. Each plunger 134 is aligned with a lock bore 94 and a plunger bore 108 in drive plate 76 and driven plate 78, respectively, so that it normally extends through bores 108 and 86 past a respective drive member 120. To this end, arcuate portion 126 is provided in drive member 120. Drive member 120 is thus configured to extend around plunger 134 in closely spaced relation when drive member 120 is mounted on its mounting bolt 52, and arcuate portion 126 is formed to abut a respective protruding plunger 134 upon angulr rotation of plates 76 and 78.

Figure 7:
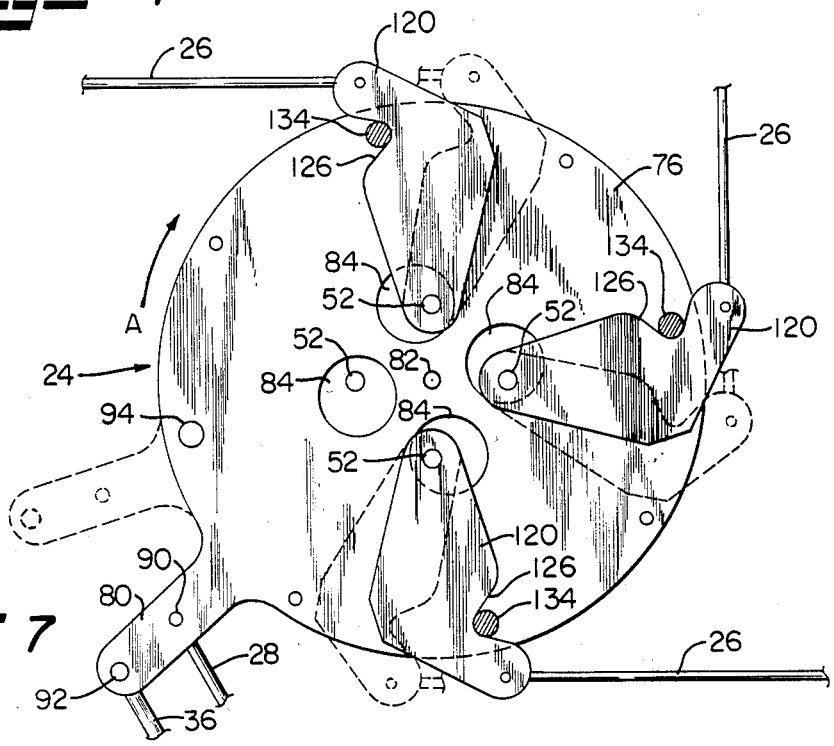
FIG. 7 is a top plan view of a portion of the drive mechanism showing the drive disc and drive members according to the preferred embodiment of the present invention.

The operation of drive mechanism 24 may now be more fully understood and appreciated with reference to FIG. 7. As is shown in FIG. 7, drive plate 76 has two limits of rotation, with the orientation shown in phantom being a beginning/end position while the solid line representation shows the mid-cycle position. To this end, FIG. 4 shows display unit 10 in a display mode which is the display state at the beginning of a drive cycle or at the end of the drive cycle. The limits of motion are defined by the cam 34 and radial arm 80, and it should be appreciated that holes 84 and 106 are sized to permit overtravel so that plates 76 and 78 may rotate without jamming. In the preferred embodiment rotation of twenty degrees has proved sufficient for operation.

It should be appreciated that, as drive plates 76 and driven plate 78 are moved in a reciprocal manner, solenoids 130 may be selectively operated to implement movement of desired ones of drive members 120 so that selected shuttering assemblies 22 may be operated to display the desired symbol. To this end, drive members 120 are normally biased, as described below, into the position shown in FIG. 7. When a plunger 134 extends through its respective bores 108 and 86, subsequent rotation of drive plate 76 in the direction shown by arrow A in FIG. 7 causes a corresponding drive member 120 to move into the position shown in phantom in FIG. 7 since plunger 134 abuts arcuate portion 126 and thus forces drive member 120 to pivot on its bolt 52. However, if a selected solenoid 130 is activated so that plunger 134 is withdrawn from bores 86 and 108, the respective drive member 120 is not forced to pivot when drive plate 76 is rotated in direction of arrow A.

Hence, rotation of drive plate 76 and driven plate 78 from mid-cycle to end cycle causes operation of those drive members 120 which have solenoids that are not activated during this portion of the cycle. Conversely, for those drive members 120 that have solenoids 130 which are activated, no movement of such drive members 120 occurs during rotation from mid-cycle to end cycle since the respective plunger rods are withdrawn and do not force the pivoting of drive members 120. The selection is made by a user and is implemented by means of the activation circuit described below with respect to FIG. 10 and a plurality of microswitches 136 which are attached to flanges 68 of outer plate 64 in any convenient manner. Plate 54 provides a limit stop for plungers 134 to prevent plungers 134 from overextending out of solenoids 130 since the free ends of plungers 134 will abut plate 54. Plate 54 could be eliminated where solenoids 130 provide internal limit stops for plungers 134.d As is shown in FIG. 6, microswitch 136 has a switch lever 138 which has an on position shown as a solid representation in FIG. 6 and an off position shown in FIG. 6 in phantom. A pair of electrical leads 140 is provided to permit convenient attachment of electrical leads to each microswitch 136. It should now be appreciated that detent holes 112 are provided to mechanically operate microswitches 136 by mechanically moving switch arms 138 as driven plate 78 is reciprocally rotated with respect to outer plate 64. Specifically, switch 138 is positioned and biased so that microswitch 136 is activated when switch arm 138 can extend into a respective hole 112. When hole 112 is rotated away from switch arm 138, though, switch arm 138 is elevated into the position shown in phantom in FIG. 6 to deactivate its respective microswitch 136. Thus, when plunger 134 is aligned with arcuate portion 126 of drive member 120 such that it may extend past drive member 120, each switch arm 138 extends into a respective hole 112 on drive plate 78 and the microswitches 136 are activated. However, when solenoids 130 and plungers 134 are rotated away from this position, microswitches 136 are deactivated as a result of the elevation of switch arms 138 out of their respective holes 112. The holes 112 are designed so that this only occurs after plungers 134 are moved out of alignment with arcuate portions 126 and are oriented over the main body portion of drive members 120.

As noted above, drive mechanisms 24 are adapted to operate a plurality of shutter assemblies 22 so that a selected symbol may be presented on display 10. The construction of shuttering assemblies 22 can be seen in greater detail with respect to FIGS. 4, 8 and 9, and it should be understood that there is a shuttering assembly 22 for each element a–g. To this end, elements a–g are formed by windows or openings in front wall 14 of housing 12, such as opening 142 shown in FIG. 3. Since it is desired to isolate openings 142 from the external environment, a transparent, anti-glare glazing 144 is mounted to enclose housing 12 with cover 144 being mounted in closely spaced apart parallel relation to front wall 14.

Figure 8:
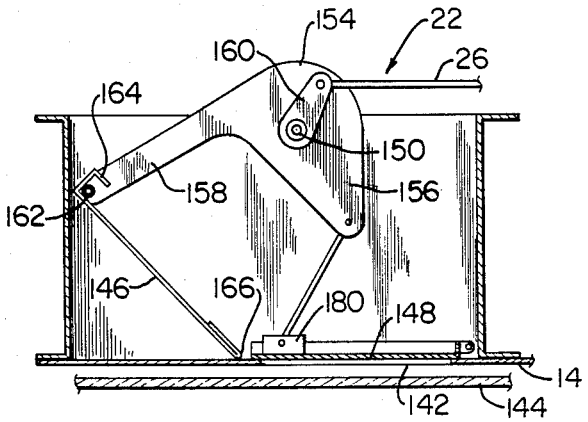
FIG. 8 is a cross-sectional view of a shuttering apparatus for the segment display shown in a "display" mode.
Figure 9:
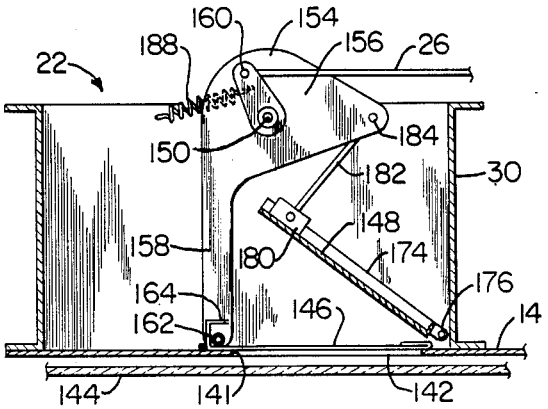
FIG. 9 is a cross-sectional view of the shuttering apparatus of FIG. 8 shown in a "no display" mode.

As seen in FIGS. 4, 8 and 9, shuttering assemblies 22 include a first opaque shutter panel 146 and a second translucent shutter panel 148. Panels 146 and 148 are moved into and out of masking relationship with respect to opening 142 upon operating of drive mechanisms 24. To this end, an axle 150 is rotatably journeled between support walls 152 and rigidly supports a pair of cam members 154 adjacent its opposite ends. Each cam 154 has an enlarged head 156, which is secured to axle 150, and an elongated arm 158 which extends away from head 156 in a common plane therewith and is generally perpendicular to opening 142 when panel 146 masks the opening 142. Axle 150 is oriented along a line that is parallel to the plane of opening 142, and elongated arms 158 are oriented so that it is generally perpendicular to the plane of opening 142 when opaque panel 146 masks opening 142 as is shown in FIG. 9. Axle 150 also rigidly supports a dog 160 with dog 160 being attached in any convenient manner to a respective drive rod 26. Thus, each drive rod 26 interconnects a drive member 120 with a dog 160 so that movement of rod 26 causes rotation of axle 150.

Opaque panel 146 is configured to cover opening 142, which, in the preferred embodiment, are both generally rectangular in shape. It should be understood that both the openings 142 and panels 146 and 148 could take different geometric shapes. Panel 146 is mounted at two corners between cams 154. These corners are on a common longitudinal edge and are pivotally secured to cams 154 by means of a pair of pivot pins 162 at the ends of elongated arms 158. Panel 146 has a return lip 164 which forms a channel in which pivot pins 162 extend, with return lip 162 extending along the longitudinal edge between pins 162 to lend further structural rigidity to panel 146.

If it is desired that opening 142 be masked by panel 146, shuttering apparatus is placed in the orientation shown in FIG. 9. However, when axle 150 is rotated in a clockwise direction from that shown in FIG. 9, cams 154 are likewise rotated in a clockwise direction. This causes opaque panel 146 to be withdrawn from opening 142 to the orientation shown in FIG. 8. It should also be appreciated that the length of panel 146 is selected to be slightly larger than the length of opening 142 so that opposite edges of panel 146 will slide along the interior surface of front wall 14 as panel 146 is moved into and out of a masking relationship with opening 142. Accordingly, pivot pins 162 are provided to allow panel 146 to pivot with respect to elongated arm 158 thereby compensating for changes of orientation during this sliding motion. Further, a reduced friction surface may be provided on the interior side of front wall 14, such as, by placing a coating of low friction material along the areas of sliding engagement between front wall 14 and panel 146. To insure that a leading edge 166 maintains contact with front wall 14, a tab 168 is connected to a mid-portion of return lip 164, as is shown in FIG. 4, with tab 168 being connected at its opposite end to axle 150 by means of a spring 170. Spring 170 may be mounted to axle 150 in any convenient manner, such as by a hole 172 which receives a hooked end of spring 170. Spring 170 maintains a tension on tab 168 so that leading edge 166 maintaining contact with the surface of front wall 14.

As noted above, shuttering assemblies 22 also include a second panel, such as translucent panel 148. It is desirable that translucent panel 148 also be able to move into and out of masking relationship with opening 142. Thus, panels 146 and 148 alternately expose and mask opening 142 with panel 148 being pivoted into a masking relationship with opening 142 when panel 146 is slid away from opening 142. Panel 148 pivots out of masking relationship when panel 146 is slid back into a masking position over opening 142. When panel 146 is in position over opening 142, the shutter is in a no display mode, and when panel 148 is in position over opening 142 the shutter is in a display mode.

To accomplish this alternate masking, translucent panel 148 is configured to cover opening 142 and, in the preferred embodiment, is generally rectangular in shape. Panel 148 has a pair of edge walls 174 along its shorter edges with edge walls 174 being pivotally secured between support walls 152 by means of pivot pins 176 which are rotatably journeled in support walls 152. In this manner, translucent panel 148 has a longitudinal edge 178 which extends along a longitudinal edge 141 of opening 142 in generally parallel relationship thereto. Edge walls 174 each support a small bracket 180 on an end opposite its respective pivot pin 176, and a small connecting rod 182 extends between each bracket 180 and a nose 184 of cam head 156. Connecting rods 182 are pivotally secured in any convenient manner at both points of connection to bracket 180 and to nose 184. As is shown in FIG. 4, each connecting rod 182 has an elongated mid-portion terminating in a pair of right angle bent ends 186 which extend through mounting holes in its respective bracket 180 and nose 184.

When shuttering assemblies 22 are operated by drive mechanisms 24, it is desirable that drive rods 26 only operate under tension to rotate axle 150 in a clockwise direction in the view of FIGS. 8 and 9. In order to accomplish this, shuttering assemblies 22 and thus cams 154 are biased for counter-clockwise rotation such that opaque panel 146 is biased into a masking relationship with opening 142. This is accomplished by a spring 188 that interconnects one of cams 154 and its adjacent support wall 152. Spring 188 is attached in any convenient manner. To achieve proper biasing, the point of attachment of spring 188 and axle 150 define a plane through which cam 154 passes. It is important that spring 188 be attached to enlarged head 156 of cam 154 on a portion thereof which is on a side of that plane which is opposite the side containing pivot pins 162.

Hence, when shuttering assembly 22 is moved from the position shown in FIG. 9 to the position shown in FIG. 8, which is accomplished by moving drive rod 26 shown in FIG. 9 to the right, spring 188 is expanded. When it is desired to allow shuttering assembly 22 to move from the position shown in FIG. 8 to that in FIG. 9, tension is released on drive rod 26, and spring 188 causes counter-clockwise rotation of cam 154 from the position shown in FIG. 8. It should thus be appreciated that the orientation of shuttering assembly 22 shown in FIG. 4 is the same as FIG. 8 so that FIGS. 4 and 8 show the shuttering assembly in a "display" mode while FIG. 9 shows the shuttering assembly 22 in a "no display" mode.

Accordingly, it should be understood that, at any time, the symbolic display on display unit 10 corresponds to the array of translucent panels 148 that are positioned over their respective openings 142, as is generally known in the art. This, of course, is accomplished by selectively activating the array of shuttering assemblies 22 which correspond to display elements a–g which is, in turn, accomplished by means of drive mechanisms 24. This operation can now be more fully appreciated.

Specifically, as is shown in FIG. 2, a pair of drive mechanisms 24 are provided and are linked together by link rod 28 which interconnects respective radial arms 80 on respective drive plates 76. Motor 32 is secured in housing 12, such as, on support structure 30, with motor 32 being a standard, one-cycle gear head motor with a homing switch. Thus, upon activation of motor 32, it completes one full cycle of rotation and then stops until subsequently activated again. With reference to FIG. 2, then, when motor 32 is activated, cam 34 causes both drive plates 76 on both drive mechanisms 24 to rotate since link rod 36 moves one such drive plate 76 and link rod 28 interconnects the first drive plate with the corresponding drive plate on the other of drive mechanisms 24. Preferably, both of drive plates 76 are caused to rotate reciprocally through approximately twenty degrees of angular rotation with this magnitude being controlled by the size of cam 34, the size of radial arm 80 and the points of attachment of link rods 28 and 36. Of course, the size of holes 84 and 106 as well as the diameter of bushing 85, as described above, could limit this motion so that they must permit the degree of rotation established by the motor linkage to avoid jamming the mechanism. Preferrably, holes 84 and 106 are sized to permit overtravel of plates 76 and 78.

Motor 32 has a homing position which corresponds to the "display" mode so that display unit 10 is normally in a display mode at the start of a cycle. Upon activation, motor 32 starts in the "display" mode, cycles through a mid-cycle of "no display" mode, and terminates at the end of the cycle with a return to the "display" mode. The end cycle thus corresponds to the start cycle of the next successive cycle of motion. It should be appreciated that drive rods 26 are operated by drive members 120 with movement of drive members 120 being governed by movement of driven plate 78 and solenoids 130 mounted thereon.

As noted above, plungers 134 are biased in a normally outward position such that they abut intermediate plate 54 and slide there along. In such a position, rotation of driven plate 78 from a mid-cycle or "no display" mode to the end cycle or "display" causes plunger rods 134 to engage drive members 120 and move them from the position shown in FIG. 7 to the position shown in phantom in FIG. 7. This is because plunger rods 134 extend through plunger bores 108, past arcuate portion 126 of drive member 120 and into lock bores 86. Rotation of drive plate 76 and driven plate 78 while plungers 134 are in this position forces the drive members 120 to pivot on bushings 88 thereby putting tension on drive rods 26 to rotate axles 150. If all drive members 120 are engaged, all segments a–g are placed in a display mode at the end of the cycle.

It should thus be understood that a desired symbol may be presented by display unit 10, with this being accomplished by permitting only selected ones of solenoids 130 to engage their respective drive members 120. This is accomplished by activating selected solenoids 130 to withdraw an associated plunger 134 into the interior of the solenoid so activated. Any plunger 134 so withdrawn from intermediate plate 54 thus does not engage its associated drive member 120 as drive plate 76 and driven plate 78 are rotated from mid-cycle to end cycle. By failing to engage drive member 120, its associated drive rod 26 remains in a relaxed position so that spring 188 of its associated shutter assembly 22 retains that shuttering assembly in a "no display" mode wherein opaque shutter 146 masks opening 142.

Figure 10:
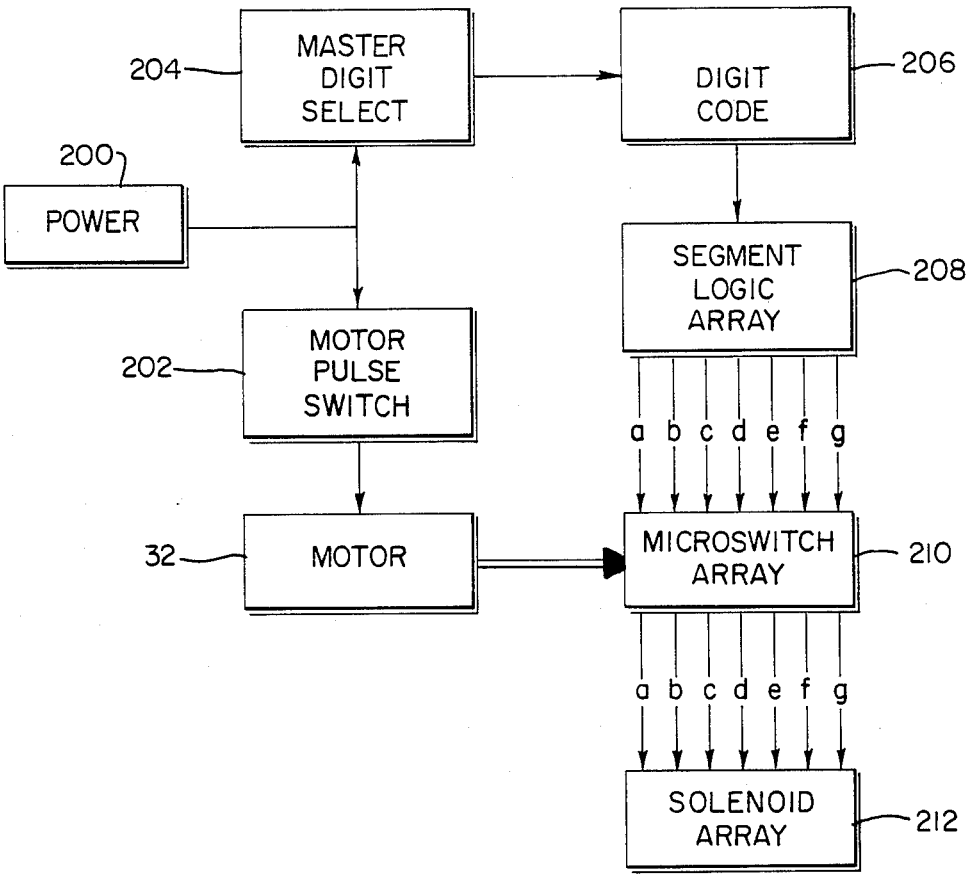
FIG. 10 is a block diagram showing the control circuit for displaying a selected digit on the digital display shown on FIG. 1.

Selective activation of desired solenoids 130 is controlled by means of a control circuit such as that shown in FIG. 10, with this circuitry being generally understood in the art by an ordinary skilled person. As is shown in FIG. 10, electrical energy is provided from a power source 200 which provides power both to a motor pulse switch 202 and to a digit select switch 204. Digit select switch 204 allows a user to select, for example, a digit from 0 through 9 or blank state on a master control. This selection then is converted into a digit code on an encoder 206 which then supplies power to a segment logic array 208 which is formed by a diode logic circuit. Logic array 208 then selectively supplies power to electrical leads corresponding to elements a–g of the digital display unit 10. These electrical leads provide current to microswitches 136 which, as a group, are represented by microswitch array 210. Motor 32 in turn mechanically drives microswitch array 210 as is shown in FIG. 10.

It should be now appreciated that power is supplied to the microswitches in a manner that corresponds to the desired digit to be displayed. However, since microswitches 136 are normally off due to the elevation of switch arm 138, as is shown in phantom in FIG. 6, no power is being used by the unit while it is in the "display" mode. Therefore, the user may select the desired digit with master digit select switch 204, and the selection process organizes the logic for the desired display, but does not alter the display being pesented by display unit 10. However, upon activating motor pulse switch 202, power is provided to motor 32 and motor 32 begins to rotate drive plate 76 and driven plate 78 through one cycle of movement. As drive mechanism 24 begins to rotate, detent holes 112 are rotated toward respective microswitches 136. Holes 112 provide detents for switch arms 138.

Immediately prior to mid-cycle, switch arms 138 extend into detent holes 112 to activate all microswitches 136 and microswitch array 210. When the microswitch array is activated, power is presented to the solenoid array 212 which corresponds to the group of all solenoids 130. However, power is only supplied to those solenoids 130 in solenoid array 212 as determined by segment logic array 208. Solenoids 130 so determined are activated to withdraw their respective plungers 134. After mid-cycle, drive plate 76 and driven plate 78 rotate in the opposite direction. Those solenoids which are deactivated as a result of a "no power" condition from the segment logic array 208 engage their respective drive members 120. Correspondingly, the plungers 134 of those solenoids which are activated by segment logic array 208 do not engage their respective drive members since those plungers 134 are withdrawn into solenoids 130.

Detent holes 112 are sized so that, after plungers 134 are moved out of alignment with open space provided by arcuate portion 126 of their respective drive member 120, all microswitches 136 in microswitch array 210 are deactivated to release all plunger rods. Those plunger rods 134 which do not engage their respective drive members 120 then slide along the upper surface of drive members 120 so that the corresponding shuttering assemblies 22 remaining in a "no display" mode. After motor 32 shuts off, the display maintains without further power consumption other than for lighting. It should also be understood that this operation causes all shuttering assemblies 22 either to enter or remain the "no display" mode at mid-cycle prior to entering the "display" mode at end cycle.

It should be understood that appropriate electrical wiring is to be provided to interconnect solenoids 130, microswitches 136 and an electrical power source. This wiring has not been shown since it is believed to be of a fairly straightforward process well known to one ordinarily skilled in the art. It should also be noted that one convenient way of wiring the solenoid and diode logic circuit would be to provide power to one side of solenoids 130 through the diode logic and ground the other side of solenoids 130 through a common microswitch 136. In this manner only one microswitch 136 needs to be employed.

It should further be appreciated that the present invention, in the preferred embodiment, allows for a symbol display in a daytime or nighttime environment. Preferably, the exterior surface of front wall 14 is selected to be a flat, relatively dark color, and the external surface of opaque panels 146 are colored the same as front panel 14. Translucent panels 148 are preferably of a contrasting color and, since panels 148 are translucent, the unit may be backlit so that the display will be created by light passing through those translucent panels 148 which are in a "display" mode. This backlighting can be accomplished in any manner known in the art, such as, by incondescent or florescent lights mounted in housing 12 at appropriate locations.

The present invention provides several advantages over the prior art both in its structure and in the method that a display is created. Specifically, the present invention includes the method of providing a drive rod and a drive member connected to a shutter panel assembly with at least one panel positionable over a display opening or a window. A drive plate carrying engagement means for selectively engaging the drive members in reciprocally moved past the drive members in a full cycle of motion. The engagement means are implemented at mid-cycle to engage selected drive rods so that the selected pattern of the drive rods operate thin shutter panels to prevent the display. All panels are thus moved into a no display mode at mid-cycle. Preferably, the method includes the other steps including biasing of the shutter panels into a no display mode. Also, a disc shaped drive plate may be provided which is rotated reciprocally past drive members that are pivotally attached. In this manner the drive members are pivoted to operate the drive rods. A second shutter panel in each shutter assembly each of which second shutter panels may be pivoted into a position masking the openings when the first shutter panels unmask the openings.

The advantage of this method provides for a somewhat positive engagement of the second panels with their respective openings so that a flat, sturdy display is provided. Such positive engagement further helps to seal the openings against the external environment thereby further protecting the internal parts of the apparatus. This is advantageous, especially where a cover plate 144 is not provided for the display unit. Further, since the interior of the housing is fairly open, backlighting provides a convenient method for permitting night observation of the display.

It should be appreciated that the present invention relates to a preferred drive mechanism and to a preferred shuttering assembly. It should be understood that other shuttering assemblies could be operated by this drive mechanism where those shuttering assemblies are operated by pull rod drive. Further, it would be possible to operate this shuttering assembly by a drive different from drive mechanism 24 where such drive mechanism was capable of operating a push/pull rod.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

We claim:

1. Apparatus adapted for selectively masking an opening in a flat panel surface, comprising:

a rotatable axle rotatable between first and second positions;

a first cam member adjacent a first end of said axle and a second cam member adjacent a second end of said axle opposite said first end, said first and second cam members secured to said axle for common rotation therewith;

a first shutter panel configured for masking said opening and secured to said first and second cam members whereby rotation of said axle into said first position moves said first shutter panel into a masking relationship with said opening and rotation of said axle into said second position moves said first shutter panel out of said masking relationship;

a second shutter panel configured for masking said opening, said second panel pivotally secured to said panel surface along a first edge of said opening and being secured to said first and second cam members whereby rotation of said axle into said second position pivots said second shutter panel into a masking relationship with said opening and rotation of said axle into said first position pivots said second shutter panel out of said masking relationship; and rotation means associated with said axle for rotating said axle between said first and second positions.

2. Apparatus according to claim 1 wherein said first shutter panel is constructed of an opaque material and said second shutter panel is constructed of a translucent material.

3. Apparatus according to claim 1 wherein said axle is oriented substantially parallel to the plane of said opening in a direction corresponding to a major axis thereof.

4. Apparatus according to claim 3 wherein said first and second cam members each has an elongated arm extending generally radially of said axle, said first shutter panel having a leading edge pivotally secured between the free ends of said elongated arms and a trailing edge opposite said leading edge, said trailing edge being in sliding engagement with a portion of said panel surface adjacent said opening as said axle is rotated.

5. Apparatus according to claim 4 wherein said elongated arm is oriented substantially perpendicular to the place of said opening when said first shutter panel is in a masking relationship with said opening.

6. Apparatus according to claim 5 including a flange bracket on the leading edge of said first shutter panel and first bias means interconnecting said flange bracket and said axle for biasing said leading edge in a generally radial direction towards said axle.

7. Apparatus according to claim 3 wherein said first and second cam members each has an enlarged head having a nose portion, said second shutter panel having a first edge oriented along one edge of said opening and being pivotally secured to said flat panel surface adjacent opposite corners of said first edge to define a pivot axis therefor, and including connecting means interconnecting each nose portion with a portion of said second shutter panel for causing pivotal movement of said second shutter panel when said first and second shutter panel is moved into and out of a masking relationship with said opening.

8. Apparatus according to claim 1 including a dog member attached to said rotatable axle, said rotation means including a drive rod secured at one end to said dog member at an opposite end to a movable drive member and including drive means associated with said drive member for moving said drive member and drive rod whereby said dog member rotates said axle.

9. Apparatus according to claim 7 wherein said drive member is pivotally mounted to a housing structure containing said flat panel surface, said drive means including a disc member rotatably mounted to said housing structure for rotational movement past said drive member and including selectively actuable engagement means on said disc member for selectively engaging said drive member.

10. Apparatus according to claim 9 wherein said engagement means includes a solenoid having a plunger adapted to engage said drive member.

11. Apparatus according to claim 1 including means associated with said axle for biasing said axle into a selected one of said first and second positions.

12. A multiple shutter display unit adapted to display a symbol in segment format wherein different ones of said segments define different symbols, comprising;

a housing structure including a front panel having a plurality of openings defining an array of symbol segments, a rear wall and surrounding sidewall;

a support structure mounted in said housing structure;

a plurality of shutter assemblies mounted in said housing adjacent each opening, there being one shutter assembly for each said opening, each said shutter assembly having a first movable shutter panel adapted to selectively mask and unmask said opening whereby said opening is in a display mode when unmasked and in a no display mode when masked and a control rod for moving said first panel between the display and no display modes;

drive apparatus mounted on said support structure and including a rotatable drive disc reciprocally movable between first and second rotational positions;

a plurality of movable drive members each connected to a respective control rod and movably mounted in said housing;

selectively actuable engagement means mounted on said drive disc and movable in common rotation therewith for engaging selected ones of said drive members during reciprocal movement of said drive disc whereby selected ones of said first shutter panels are moved into and out of the display and no display modes; and drive means connected to said drive disc for reciprocally rotating said drive disc upon command.

13. A shutter display unit according to claim 12 including a plurality of drive apparatus each having a rotatable drive disc and linkage means interconnecting said drive apparatus for causing corresponding rotation of each said drive disc upon rotation of one of said drive discs, said drive means being connected to one of said drive discs, each said drive disc having engagement means thereon for selectively engaging selected ones of said drive members.

14. A shutter display unit according to claim 13 wherein each shutter assembly includes an axle rotatably journaled in said housing in spaced relation to said opening and supporting a dog member, said dog member connected to a respective drive rod whereby movement of said drive rod operates to rotate said axle to move the corresponding first shutter panel into and out of masking relationship with said opening.

15. Shutter display unit according to claim 14 wherein each said shutter assembly includes a pair of cam members secured to said axle, said first shutter panel extending therebetween whereby rotation of said axle moves said first shutter panel into and out of masking relationship with said opening.

16. A shutter display according to claim 15 wherein each said shutter assembly includes a second shutter panel having a first edge portion pivotally secured along one edge of said opening and a second edge portion connected to said cam members whereby rotation of said axle causes said second shutter panel to pivot into and out of a masking relationship with said opening respectively when said first shutter panel is moved out of and into a masking relationship with said opening.

17. A shutter display according to claim 16 wherein the external surface of said front panel and the external surface of each first shutter panel have a common color and wherein the surface of each said second shutter panel facing its respective opening has a contrasting color to external surface of said front panel.

18. A shutter display according to claim 17 wherein said second shutter panel is translucent and including internal illumination means in said housing for back lighting said openings.

19. A shutter display unit according to claim 17 including a spring interconnecting one of said cam members and said housing structure and operative to bias said shutter assembly into a no display mode.

20. A shutter display unit according to claim 13 wherein said engagement means includes a solenoid corresponding to each said drive member and mounted on one of said drive discs for common rotation therewith, each solenoid having a plunger movable thereby, each said plunger adapted to engage its drive member in a first position and to release said drive member in a second position whereby the rotation of the drive discs when selected ones of said plungers engage their respective drive members causes movement of those drive members thereby operating their respective shutter assemblies, and switchable power means associated with said solenoids for selectively actuating selected ones of said solenoids to operate their respective plungers.

21. A shutter display unit according to claim 20 wherein said drive discs reciprocate through a cycle wherein said shutters are in a display mode at the start of the cycle, are in a no display mode at mid-cycle and return to a display mode at end cycle, each end cycle corresponding to the start cycle of a next successive cycle, said switchable power means including switchable logic circuit means for providing power to selected ones of said solenoids and at least one switch operative activate said selected ones of solenoids at mid-cycle and to deactivate said solenoids at start and end cycle.

22. A shutter display unit according to claim 21 wherein said switch is mounted to said housing structure adjacent one of said drive discs and has a follower arm in contact therewith, said drive disc associated with said follower arm having detent means for moving said follower arm to operate said switch.

23. A shutter display unit according to claim 13 wherein said drive means includes a single cycle motor with a homing switch, said motor being driveably connected to one of said drive discs.

24. A shutter display unit according to claim 12 including a transparent, anti-glare glazing mounted to said housing structure in spaced, substantially parallel relation to said front panel on a side thereof opposite said shutter assemblies.

25. In a display unit for displaying a selected symbol formed out of an array of symbol segments defined by windows wherein selected windows are selectively masked and unmasked by a first shutter panel, the method of creating said display comprising the steps of:

providing a drive rod associated with each first shutter panel and a movable drive member connected to each first shutter panel;

providing a drive plate carrying engagement means for selectively engaging said drive members;

reciprocating said drive plate past said drive members through a start cycle corresponding to a display mode, a mid-cycle corresponding to a no display mode, and an end cycle corresponding to a display mode, said end cycle corresponding to the next successive start cycle;

moving all said first shutter panels into a no display mode at mid-cycle wherein all said first shutter panels mask said windows; and implementing said engagement means at mid-cycle to engage selected ones of said drive members whereby movement of said drive plate from mid-cycle to end cycle causes movement of said selected ones of said drive members to operate their respective first shutter panels.

26. The method according to claim 25 wherein said drive plate is disc shaped and the step of reciprocating said drive plate includes rotating said drive plate in an angular direction.

27. The method according to claim 26 wherein said drive members are pivotally moved by said engagement means and including the further step of biasing said first shutter panels into a no display mode.

28. The method according to claim 25 including the steps of providing a second shutter panel corresponding to each first shutter panel for selectively masking said openings and pivoting said second shutter panels into and out of masking relationship with their respective opening when their corresponding first shutter panels are moved out of and into a masking relationship, respectively.

29. The method according to claim 28 wherein said first and second shutter panels are moved to positively engage said windows.

30. The method according to claim 29 including the step of back lighting said windows.

* * * * *

UNITED STATES PATENT AND TRADEMARK OFFICE

CERTIFICATE OF CORRECTION

PATENT NO. : 4,496,945

DATED : January 29, 1985

INVENTOR(S) : Robert C. Stadjuhar and Cecil S. Renfro

It is certified that error appears in the above-identified patent and that said Letters Patent is hereby corrected as shown below:

In column 1, line 20, delete "sometime" and substitute --some time--.
In column 1, line 28, delete "presenta" and substitute --present a--.

In column 3, line 35, after "masking" insert --and unmasking--.
In column 3, line 36, delete "opening" and substitute --openings--.

In column 5, line 46, delete "other" and substitute --over--.
In column 7, line 50, delete "angulr" and substitute --angular--.
In column 8, line 33, after "134." delete "d".
In column 12, line 37, delete "pesented" and substitute --presented--.

Signed and Sealed this

*Twenty-ninth* Day of *October 1985*

[SEAL]

*Attest:*

DONALD J. QUIGG

*Attesting Officer*

*Commissioner of Patents and Trademarks—Designate*